US005188484A

United States Patent [19]

White

[11] Patent Number: 5,188,484

[45] Date of Patent: Feb. 23, 1993

[54] JACK-UP TYPE OFFSHORE OIL AND GAS PRODUCTION PLATFORM AND METHOD

[75] Inventor: George T. White, Belle Chasse, La.

[73] Assignee: Self Installing Platforms, Inc., Belle Chasse, La.

[21] Appl. No.: 699,017

[22] Filed: May 13, 1991

[51] Int. Cl.[5] ..... E02B 17/08

[52] U.S. Cl. ..... 405/198; 405/200; 405/205; 405/206

[58] Field of Search ..... 405/196, 198, 199, 200, 405/203, 205, 206, 207

[56] References Cited

U.S. PATENT DOCUMENTS

| | | | |
|---|---|---|---|
| 4,161,376 | 7/1979 | Armstrong | 405/196 |
| 4,456,404 | 6/1984 | Evans | 405/196 |
| 4,472,084 | 9/1984 | Boon | 405/196 X |
| 4,497,591 | 2/1985 | Gillis | 405/198 |
| 4,505,616 | 3/1985 | Grzelka et al. | 405/196 X |
| 4,652,177 | 3/1987 | Gunther, Jr. et al. | 405/196 |
| 4,657,438 | 4/1987 | Gillis | 405/196 X |
| 4,813,814 | 3/1989 | Shibuta et al. | 405/196 X |

*Primary Examiner*—Randolph A. Reese
*Assistant Examiner*—J. Russell McBee
*Attorney, Agent, or Firm*—Joseph L. Lemoine, Jr.

[57] ABSTRACT

A mobile, self-elevating, offshore production platform, for exploitation of smaller reservoirs, is provided with a liquid tight hull having a deck; a plurality of support legs, each having a gear rack and bottom footpads, which are slidably extendable through the hull; a removable jacking tower for each support leg, and, a locking means for each support leg which is engageable to the leg gear rack at any vertical position of the leg. Mineral processing equipment is pre-installed on the deck at a suitable shoreside facility. Then the platform, with legs elevated, is towed to the offshore location where minerals are to be produced. On location the legs are lowered, grounded, and then pre-loaded to desired criteria by introducing ballast water into the hull. After pre-loading the platform is deballasted and elevated to establish a desired air gap. Upon elevation a locking device is engaged to secure each leg in place and the jacking towers, tower powering equipment, and ballast pumps may then be completely removed for storage, or reuse on other platforms. Installation is completed by connecting the hydrocarbon processing equipment to influent and effluent means provided. Upon depletion of the mineral reservoir, or for other reasons such as the threat of a violent storm, the platform can be removed from one location, and reused at another, by reversing and repeating the above procedure.

5 Claims, 3 Drawing Sheets

JACK-UP TYPE OFFSHORE OIL AND GAS PRODUCTION PLATFORM AND METHOD

BACKGROUND

The invention generally relates to offshore facilities for processing fluid minerals such as oil and gas reserves. More particularly the invention relates to a mobile, reusable jack-up type production facility designed to sequentially produce a plurality of smaller, so-called marginal, reservoirs economically. More particularly the invention relates to a jack-up structure which utilizes removable jacking towers and corresponding, reversible leg locks to allow jacking tower removal and/or installation while the platform is elevated.

In recent years there has been increased demand for hydrocarbons, yet the costs of recovering them from an offshore environment has increased such that the size of a profitably exploitable reservoir has become very large. Generally hydrocarbons from large reservoirs are processed by large fixed platforms which require an enormous capital investment to build, and to demolish, when production is complete. Smaller reservoirs are customarily produced by smaller fixed platforms, which are still relatively expensive to build, install and demolish when production is complete. In a few instances jack up structures which were originally designed for drilling operations have been permanently "converted", for service as a production platform. Those jack-up type structures have not solved the small-reservoir/high-capital-or-production dilemma in that they employ expensive jacking towers, motors and power supplies which are not designed to be conveniently installed and removed at will, thus these expensive components are not capable of servicing many structures economically.

There are increasing numbers of smaller reservoirs, with respectable quantities of hydrocarbons, which could be brought to market profitably if costs of recovery could be reduced.

Sumner U.S. Pat. No. 3,716,993, discloses a type of separately navigable drill ship which may be coupled with a variety of supporting structures through a spacing jack-and coupling structure. No means is provided to remove the operation components of the jacking devices while the drill ship is elevated.

Fischer U.S. Pat. No. 3,872,679, discloses a jack-up drill vessel which utilizes a combination of main legs (extending to the bottom of the water) and semi-submersible legs (which do not extend to the bottom of the water) to support or ballast the vessel as circumstances may require. No means is provided for removal of the jacking devices while the drill ship is elevated on location.

Giblon U.S. Pat. No. 3,927,535, discloses a large, deep water, jack-up type offshore drilling and production platform, which is stacked above two underwater platform support structures. Giblon states that after the upper platform is in an elevated position and the platform has been rigidly attached to each leg by welding-in a ring girder construction, the hydraulic jacks at each leg may be removed. However, no specific jacking mechanism or means for their removal, reinstallation or reuse is provided. No means is disclosed for lowering the platform once the legs have been welded to the upper platform.

Hellerman, et al U.S. Pat. No. 4,040,265, discloses a negatively buoyant truss type frame structure which may be used to receive and drydock a variety of separately navigable vessels. Hellerman, et al, states that after elevation of the vessel the platform mechanisms may be removed, but no specific jacking mechanisms, means for removal of the jacking mechanisms or means for supporting the platform during removal is provided.

Evans U.S. Pat. No. 4,227,831, discloses a jack-up type platform having an open keyway between two of the platform legs for accommodating conductor piping. The conductor piping is supported by underwater members attached between the legs lateral to the keyway. No means is provided for removal, reinstallation or reuse of the jacking mechanisms.

Evans U.S. Pat. No. 4,456,404, discloses a jack-up type drilling or production platform slidably supported by lateral wing walls, which walls are in turn supported by grounded legs. No means is provided for removal of the jacking towers while the platform is elevated.

SUMMARY OF THE INVENTION

The present invention relates to an improved offshore, mobile, jack-up type platform for the sequentially processing of hydrocarbons from a series of small reservoirs into a saleable product The platform includes a liquid tight hull with a deck, upon which standard processing equipment, such as separators, heaters, treaters, compressors, metering devices and valves are typically pre-installed shoreside. A plurality of tubular support legs, having bottom footpads, extend vertically through liquid tight sleeves in the hull. Each support leg has an external, longitudinal gear rack, which cooperates with either a jacking tower containing a motorized pinion, or with a locking device, to raise, lower, or lock each leg in place as required. Once a locking device is engaged on a particular leg, that leg's motor, pinion, power supply and jacking tower can be removed for protected storage or for use on other platforms, thereby preventing unnecessary deterioration of expensive equipment, and providing means by which one set of jacking means may service multiple platforms.

The improved method for constructing a temporary, reusable, offshore hydrocarbon processing platform includes pre-installing production equipment on the deck of a platform as described above, towing said platform to location with its legs elevated, lowering and grounding the footpads on the seabed, pre-loading the platform by introduction of ballast water into its hull, deballasting and elevating the hull so that a desired air gap is achieved, locking the platform legs in place, removing jacking equipment and ballasting pumps for protected storage or for use on other platforms, and, connecting the production equipment to appropriate influent and effluent means. On depletion of the reservoir, or for other reasons such as storm threat, the platform may be remobilized and/or reused elsewhere by substantially reversing and repeating the above steps.

An object of the present invention is to provide a resusable offshore platform which may be used sequentially process hydrocarbons from a series of smaller reservoirs Another object of the invention is to provide a jack-up type platform which employs the use of portable jacking and ballasting equipment, which may be conveniently used to service multiple similar platforms and stored in a protected environment when not actively being used to elevate or lower a first platform.

A further object is to provide an improved offshore hydrocarbon processing platform and method which is inexpensive compared to prior art, and may therefore be utilized to bring numerous smaller reservoirs to market profitably.

DESCRIPTION OF THE PREFERRED EMBODIMENT

Figure 1:
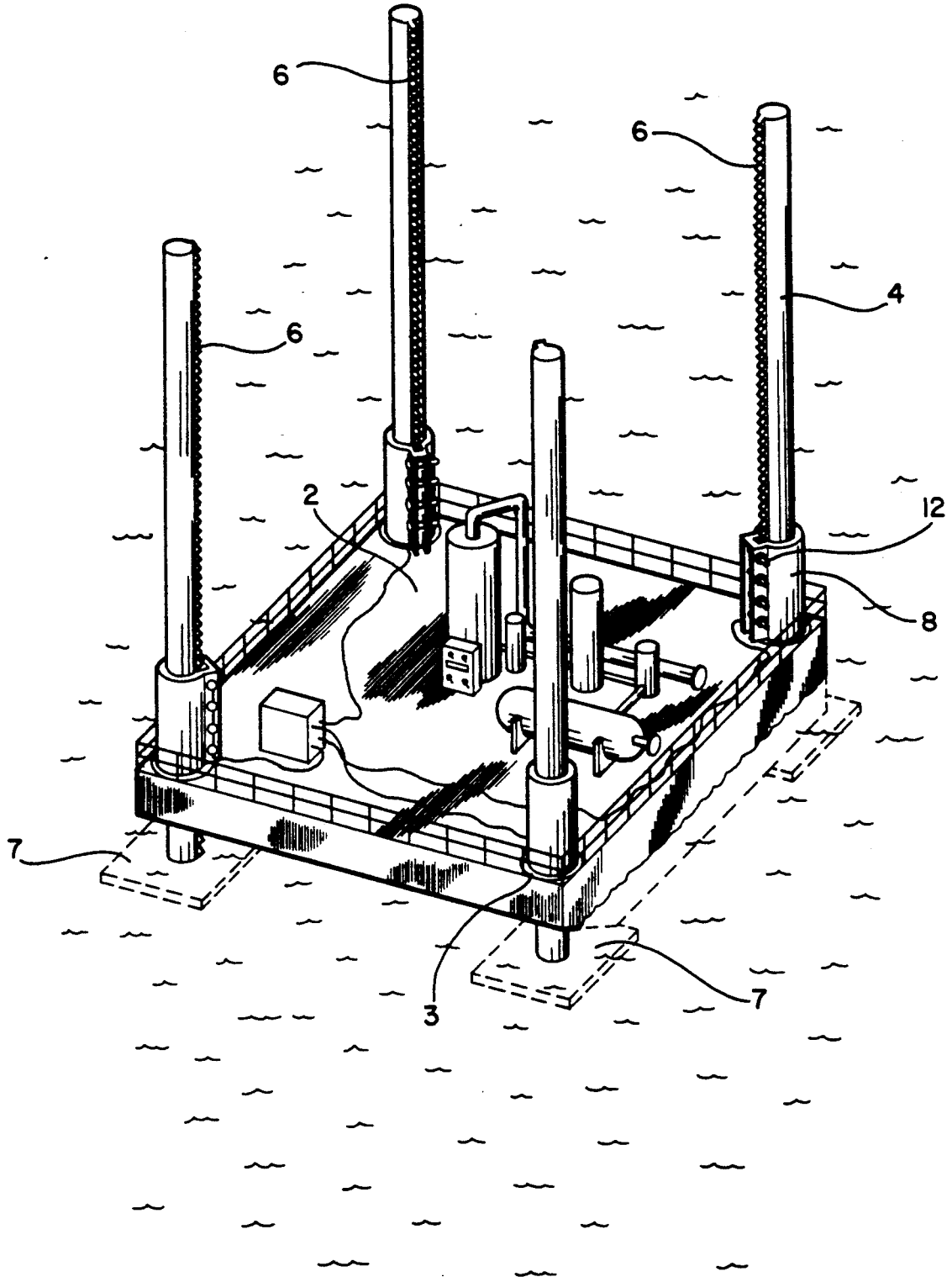
FIG. 1 schematically represents the principal components of the invention and their relationship to another, with the platform elevated under tow.
Figure 2:
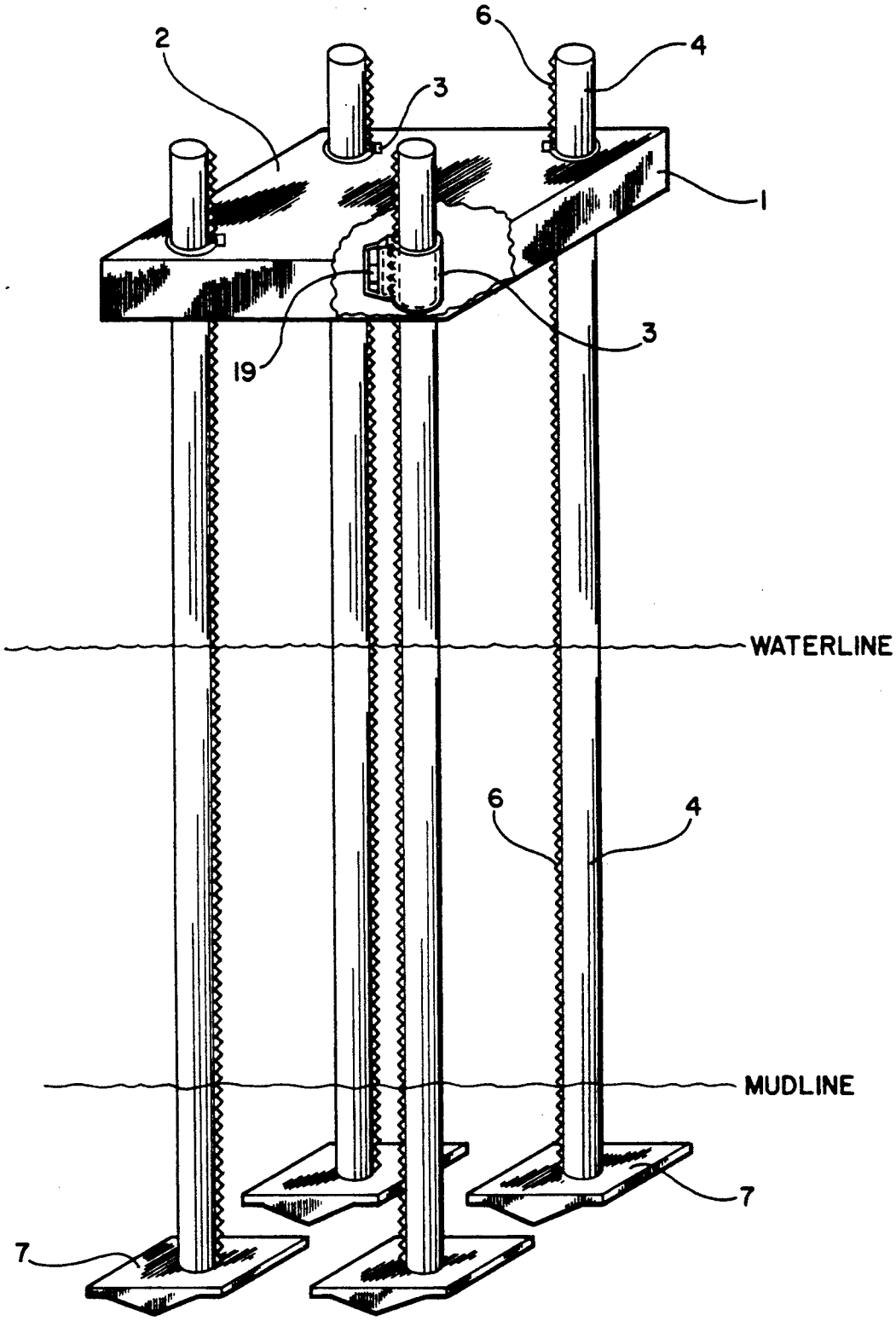
FIG. 2 schematically represents the principal component of the invention and their relationship to another, with the platform elevated and jacking equipment removed.

FIGS. 1-4 set forth the preferred enabling embodiment of the present invention. With reference to these drawings the hydrocarbon processing equipment is typically pre installed at a shoreside location on the deck 2 of a liquid tight hull 1 which is of standard framework-sheet metal construction. Hull 1 may have one or more raked ends to facilitate towing. The hull has a plurality of, typically three or four, watertight sleeves 3 which vertically penetrate the hull structure so as to allow support legs 4 to slidably cooperate therethrough. Sleeves 3 are generally cylindrical in cross-section, but have a longitudinal notch extending radially outwards so as to accommodate of leg mounted gear rack 6 therethrough.

Each support leg 4 is generally cylindrical in cross-section and is equipped with an external, longitudinally disposed gear rack 6 and horizontally disposed footpad 7 affixed to lower portion.

Gear rack 6 cooperates with one or more pinion carrying motors 12 of jacking tower 8 to raise or lower legs 4 as required. Gear rack 6 also cooperates with locking device 16 to lock the legs 4 at any position along their vertical path.

Figure 3:
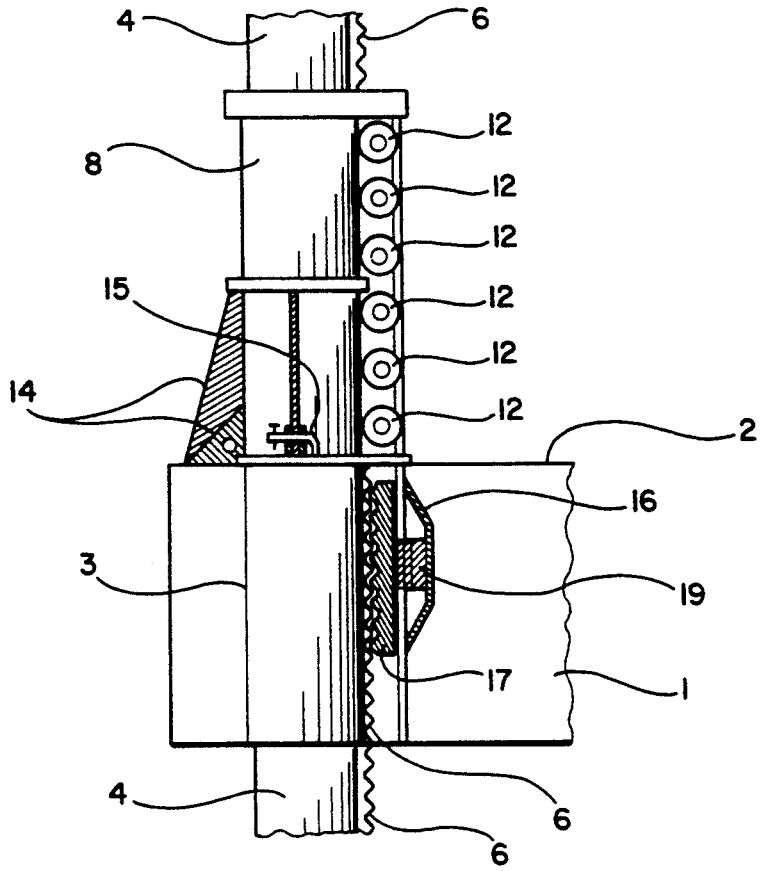
FIG. 3 is a side view of a typical jacking tower and locking device.
Figure 4:
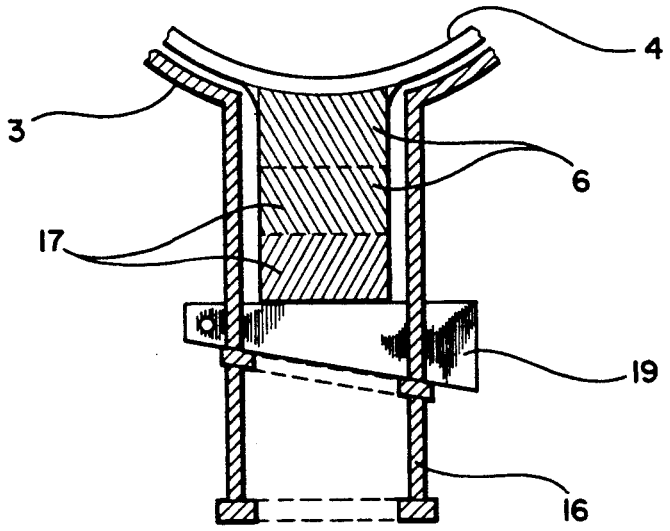
FIG. 4 is a horizontal cross-sectional view of the locking device.

With particular reference to FIGS. 3 and 4, locking device 16 is disposed below jacking tower 8, within hull 1, and is contiguous with gear rack 6. Locking device 16 is engaged to lock leg 4 in place by using wedge 19 to force locking rack 17 in toothed engagement with leg gear rack 6. Wedge 19 then may be secured in place by pin 21.

With particular reference to FIG. 3, jacking tower 8 is removably adapted to deck 2 by sets of vertically disposed clevis-plate-pin devices 14 about lower circumference of the jacking tower. Each set of three vertical plates 14 comprises a middle plate which is rigidly affixed to either jacking tower 8 or deck 2. The two laterally outward vertical plates are rigidly welded to the reverse corresponding structure, to-wit, either deck 2 or jacking tower 8. A horizontal hole through each set of vertical plates contains a removable pin 15 which is used to secure, or remove, a jacking tower as desired. As may be appreciated when the platform is not actively being raised or lowered and the locking devices have been engaged to secure the platform legs in place, the jacking towers, motorized pinions, power supplies and associated equipment are unnecessary for a time and may be removed for protected storage or use on other similar platforms. This feature of the invention allows the capital investment of relatively expensive jacking mechanisms to be distributed over multiple platforms, and better service from jacking equipment is expected by virtue of its storage in a protected environment when not being used.

The preferred method of constructing an offshore mineral processing plant according to the present invention begins with pre-installing processing equipment on the deck of the platform at a shoreside facility, as this is ordinarily less expensive than conducting said work offshore. Thereafter the platform is towed, usually with its legs fully elevated, to the first reservoir to be produced. Upon proper positioning with respect to influent and effluent means to be connected to the platform processing equipment, the jacking towers, including pinion carrying motors and electrical, hydraulic or pneumatic power supplies, are activated to lower the support legs until the footpads ground upon the seabed. Then a desired amount of ballast water is pumped into the hull of the platform, which is commonly called pre loading the platform, so as to cause the footpads to penetrate and/or compress the seabed sufficiently to support the weight of the elevated platform. When pre-loading is complete, the platform is deballasted then elevated to establish a desired air gap between the hull and surface of the water. After desired elevation is established the locking devices are engaged and the jacking towers, their powering means and the ballasting pumps may be removed for storage or use elsewhere, and appropriate influent and effluent connections are made to the processing equipment.

On depletion of the first reservoir, or for other reasons, the platform can be remobilized, by substantially reversing the above described procedure. Upon remobilization of the platform it may be moved to subseguent reservoirs or locations, possibly without return to shore if the processing equipment is suitable for production conditions at the new location. Since the invention allows for sequential processing of multiple smaller reservoirs by employing one reusable platform, the capital investment of building the platform may be distributed across multiple recovery projects, with further benefit derived from the fact that each recovery project has few, if any, demolition or equipment removal costs associated with it.

While this invention has been described by means of a specific preferred embodiment it is not intended to be limited thereto. Obvious modifications will occur to those skilled in the art without departing from the spirit and scope of the invention.

What is claimed is:

1. An improved jack-up type platform for offshore processing of hydrocarbons, comprising:

(a) a liquid tight hull having a generally flat deck suitable for installation of hydrocarbon processing equipment thereon, wherein said hull has a generally void interior suitable for containing ballast water and has a plurality of vertically disposed liquid tight, generally sleeved penetrations through the hull;

(b) generally cylindrical support legs slidably disposed through each of said sleeved hull penetrations, wherein each of said support legs has a longitudinally disposed, external gear rack and a horizontally disposed footpad on the lower extremity of each said support leg;

(c) generally cylindrical jacking towers removably affixed to the deck of said hull which cooperate with the gear rack of each support leg through motorized pinion means, to elevate or lower each support leg as required; and, (d) reversibly engagable locking means which cooperates between the gear rack of each support leg and said hull, to lock each leg at any position along its vertical path.

2. The improved platform of claim 1 wherein said jacking towers are removably affixed to the deck of said hull by a plurality of sets of vertical clevis plates disposed about the circumference of each jacking tower which are receptive to a horizontal clevis pin.

3. The improved platform of claim 1 wherein said reversably engagable locking means is comprised of a metal framework rigidly affixed to the hull of the platform at points contiguous with said longitudinal gear rack of each support leg, said metal framework receptive to a locking section of a mating gear rack, and receptive to wedge means for forcing said locking gear rack into mating engagement with said longitudinal gear rack of a support leg.

4. A method of erecting a jack-up type offshore platform for hydrocarbons comprising:

(a) installing standard hydrocarbon processing equipment on an outer surface of a liquid tight hull which has a plurality of slidably disposed elongated cylindrical support legs bearing a longitudinal gear rack and footpads, wherein each support leg has a reversibly engagable locking device and a removable jacking tower for raising and lowering said legs by pinion means, (b) thereafter towing a pre-prepared platform to the offshore hydrocarbons to be processed with the platform support legs in a raised position, (c) thereafter lowering the support legs at the site of the hydrocarbons until the footpads at the bottom of the support legs rest on the seabed, (d) thereafter pumping a desired amount of ballast water into the hull so as to press the footpads at the bottom of the legs into firm engagement with the seabed material, (e) thereafter deballasting the hull by pumping ballast water therefrom, (f) thereafter elevating the hull until a desired air gap is established between the bottom of the hull and surface of the sea, (g) thereafter engaging a locking device at each support leg to fix each leg in vertical position with respect to the hull, (h) thereafter removing the jacking towers, jacking motors, jacking power supplies, jacking power lines and ballasting pumps from the platform; and, (i) thereafter connecting the deck mounted hydrocarbon processing equipment to influent and effluent means.

5. A method for remobilizing an erected jack-up type offshore platform for processing hydrocarbons comprising:

(a) disconnecting influent and effluent means from hydrocarbon processing equipment mounted on the deck of a liquid tight hull which has a plurality of slidably disposed elongated cylindrical support legs bearing a longitudinal gear rack and footpads wherein each support leg has a reversibly engagable locking device and a removable jacking tower for raising and lowering said legs by gear means, (b) thereafter installing temporary jacking towers, jacking motors, jacking power supplies and jacking power lines on the platform, (c) thereafter disengaging locking devices at each support leg so as to allow the support legs to slidably move through the hull under the control of the jacking towers, (d) thereafter retracting the support legs until the hull is floated and then further until each support leg is fully elevated, and, (e) thereafter towing the platform to another offshore location where hydrocarbons are to be processed.

* * * * *